United States Patent [19]

Wisser

[11] 4,014,163

[45] Mar. 29, 1977

[54] CLOCKWORK FOR DESIGNATING TIME AND TIDE

[76] Inventor: Otto Wisser, Ludwig Uhlandstr. 12, 7745 Schonach, Germany

[22] Filed: Aug. 18, 1975

[21] Appl. No.: 605,650

[30] Foreign Application Priority Data

Nov. 19, 1974 Germany ..... 2454761

[52] U.S. Cl. ..... 58/3; 58/125 R; 58/126 R

[51] Int. Cl.[2] ..... G04B 19/26

[58] Field of Search ..... 58/3, 125 R, 125 B, 58/127 R, 152 R, 126 R

[56] References Cited

UNITED STATES PATENTS 3,708,971 1/1973 Wlodyka ..... 58/3

3,921,383 11/1975 Leone ..... 58/3

*Primary Examiner*—Stanley J. Witkowski

*Attorney, Agent, or Firm*—Eugene M. Eckelman

[57] ABSTRACT

The hour hand shaft of a clockwork has a first gear rotatably mounted thereon by a slip clutch. A second gear and a tide hand are secured on a bushing freely rotatable on the shaft. The second gear is connected to the first gear by a connecting gear. The second gear has a greater number of teeth than the first gear and the teeth are in selected number so that the tide hand will operate at a slower speed to proportion the rise and fall of the tides with the hours of the day. The connecting gear has a stem for rotatably adjusting the tide hand.

2 Claims, 2 Drawing Figures

HIGH TIDE
LOW TIDE
RISING
FALLING
1
2
3
4
16
17
18

1
4
5
6
7
8
9
10
11
12
13
14
15
16
17
18

CLOCKWORK FOR DESIGNATING TIME AND TIDE

BACKGROUND OF THE INVENTION

The invention relates to a clockwork with a normal time indication which is driven electrically or by means of a spring, having an hour hand shaft with an hour hand and a drive and a tide hand indicating tide conditions.

Clockworks with a front plate and a rear plate are already known, but these do not permit the indication of the tides.

As is known, the tides, i.e. ebb or low tide on the one hand, and flood or high tide on the other, are dependent on the position of the moon relative to the earth, because as a result the gravitational pull of the moon acts in a particular direction on the earth and consequently produces these tides. As the lunar month contains 27 days, 7 hours, 43 minutes and 11.5 seconds, it is not identical with the terrestrial month, so that over a period of 24 hours a tide hand must lose a certain amount of time as compared with the normal hour hand.

Furthermore, clocks wth both electrical and spring tension drive systems are known which are constructed exclusively as tide clocks.

However, all known tide clocks have the important disadvantage that they have an abnormal number of strikes in the master clock or an abnormal gear ratio in the movements, so that they cannot be used as normal clocks.

SUMMARY OF THE INVENTION

The object of the present invention is to so improve a normal clockwork by providing a third hand which indicates the tides independently of the normal time in the revolution of the other hands for hours and minutes.

According to the general inventive concept, it is necessary to provide an additional motion work for this purpose.

According to the invention, this problem is solved in that a toothed wheel is connected via a slipping clutch with the hour hand shaft, whereby a second toothed wheel is positioned on the hour hand shaft with a running fit and the said two toothed wheels mesh with the drive, whereby the reciprocal ratio of the number of teeth of the two toothed wheels is adapted to high and low tide and the second wheel is connected with a tide hand.

As a result the clock can be simultaneously used as a normal time-indicating clock and as a tide clock, without an abnormal gear ratio being necessary in the motion work for the latter purpose.

Thus, the solution of the set problem is relatively simple, because only a few additional moving parts are necessary for making from a normal clock a combined clock of the present type with simultaneous tide indication.

According to a further development of the invention, the second toothed wheel is located on a bushing, on which is also fixed the tide hand. Between the second toothed wheel and the tide hand is located the clock face which shows the tides for the third hand in addition to the normal information for telling the time.

Advantageously the driving shaft has its running fit in the rear plate and front plate. It is also advantageous to equip the end of the driving shaft with an adjusting knob for adjusting the tide hand.

Further advantages and details of the invention can be gathered from the following description of one embodiment with reference to the drawings wherein:

DETAILED DESCRIPTION OF A PREFERRED EMBODIMENT

Figure 1:
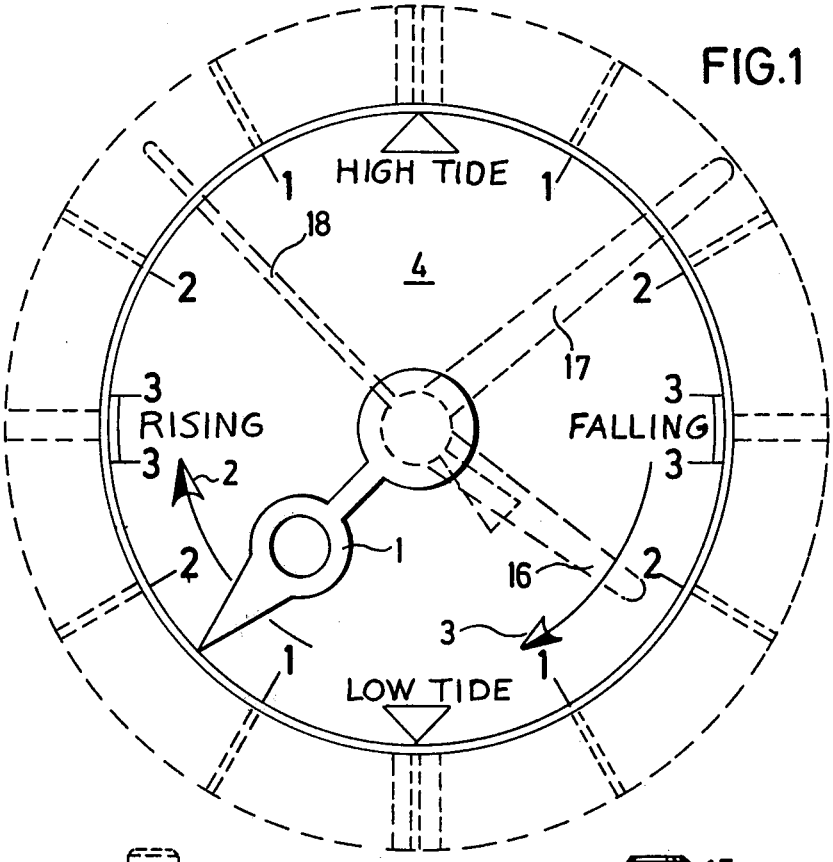
FIG. 1 is a plan view of the clock-face with the hands.

FIG. 1 partly shows a normal clock-face with the hour hand 16, minute hand 17 and second hand 18. According to the invention a tide hand 1 is also provided which revolves in the direction of arrows 2 and 3. The words "high tide", "low tide", "rising" and "falling " also appear distributed in the indicated manner over the periphery of the clock-face, so that the words "low tide" are positioned precisely opposite the words "high tide". The same applies as regards the other words, which appear in place of the FIGS. 3, 6, 9 and 12. In addition, as shown, further figures close to the words "rising" and "falling" can indicate the water level.

Figure 2:
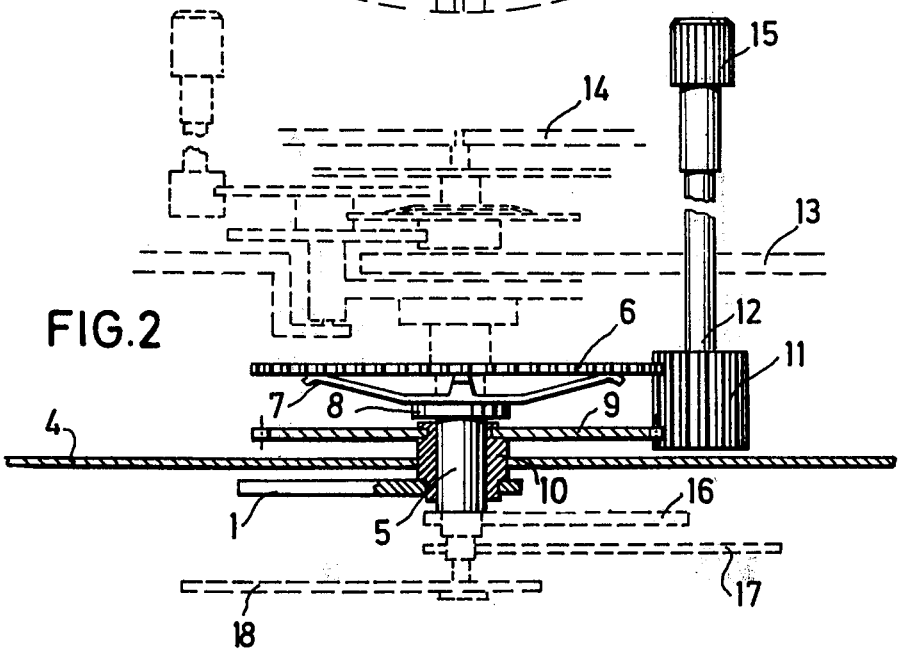
FIG. 2 is a sectional view through the middle of the hour shaft in an axial direction.

FIG. 2 shows a section through the clockwork which, other than for the subsequently described additional motion work can be of completely conventional design. Thus, the clockwork is only shown to the extent that it is linked with the additional motion work according to the invention.

The hour hand shaft and the parts shown above it in broken lines relate to the conventional part of the clockwork. According to the invention, a toothed wheel or gear 6 via a slipping clutch with a spring 7 and a bushing 8 is mounted on the hour hand shaft 5. A second toothed wheel or gear 9 is riveted to a bushing 10 which is mounted with a running fit on shaft 5. Lower down to FIG. 2 the same bushing 10 carries the tide hand 1 on the other side of clock-face 4.

As can be seen the two toothed wheels 6 and 9 jointly mesh with a connecting gear 11 which is pressed onto shaft 12. Shaft 12 has its running fit in the rear plate 14 and the front plate 13. At the end of shaft 12 is provided an adjusting knob 15 for adjusting the tide hand 1, which at the front is pressed onto bushing 10 and therefore forms a unit with toothed wheel 9.

Toothed wheel 6 revolves exactly twice daily, i.e. the same as hour hand 16 for normal time, while wheel 9 must have a specific number of teeth relative to the number of teeth of wheel 6.

The number of teeth and the center distance of drive 11 relative to the axis of shaft 5 can be selected at random.

A further advantage results from the fact that the tide indicator can be incorporated in a normal clock as it is only necessary to provide in addition wheel 6 and 9 and drive 11.

Having thus described my invention, I claim:

1. A clockwork comprising a. a casing having a front face with time indications and tide indications, b. a driven hour hand shaft journaled in said casing and having an hour hand thereon movable around said face, c. a first gear rotatable on said shaft, d. a slip clutch connected between said first gear and said shaft arranged to normally drive said gear with said shaft but allowing adjustable rotation relative thereto, e. a second gear secured on said shaft for rotation therewith, f. a tide hand secured to said second gear and movable around said face, g. a connecting gear in common mesh with said first and second gears for connecting said gears in unitary rotation, h. Said second gear having a different number of teeth than said first gear whereby to operate said tide hand at a different speed to proportion the rise and fall of the tides with the hours of the day, i. and means secured to said connecting gear for manually rotating it to set said tide hand by slippage of said first gear on said shaft.

2. The clockwork of claim 1 wherein said means for manually setting said tide hand includes a stem on said connecting gear projecting from said casing.

* * * * *